US005415343A

United States Patent [19]

Vosbikian

[11] Patent Number: 5,415,343

[45] Date of Patent: May 16, 1995

[54] PRODUCT DISPLAY BOX

[75] Inventor: Peter S. Vosbikian, Moorestown, N.J.

[73] Assignee: Quickie Manufacturing Corporation, Cinnaminson, N.J.

[21] Appl. No.: 268,233

[22] Filed: Jun. 29, 1994

Related U.S. Application Data

[63] Continuation-in-part of Ser. No. 5,666, Jan. 19, 1993, Pat. No. 5,350,111.

[51] Int. Cl.[6] ..... B65D 5/42

[52] U.S. Cl. ..... 229/162; 206/44 R; 229/115; 229/199; 229/242

[58] Field of Search ..... 229/115, 117.16, 162, 229/164, 199, 242; 206/44 R

[56] References Cited

U.S. PATENT DOCUMENTS

| | | | |
|---|---|---|---|
| 2,126,106 | 8/1938 | Goldberg | 229/242 |
| 2,242,711 | 5/1941 | Olivier | 229/162 |
| 2,611,527 | 9/1952 | Fisher | 229/162 |
| 2,701,089 | 2/1955 | Fischer | 229/162 |
| 2,902,200 | 9/1959 | Manners | 229/162 |
| 2,944,727 | 7/1960 | Moore | 229/162 |
| 3,185,378 | 5/1965 | Roseburg, Jr. | 229/115 |
| 3,860,305 | 1/1975 | Bergman | 229/199 |
| 4,339,067 | 7/1982 | Bessey | 229/115 |
| 4,354,596 | 10/1982 | Lavery | 229/162 |
| 4,549,688 | 10/1985 | Ozman et al. | 229/162 |
| 4,865,187 | 9/1989 | Zulauf et al. | 229/162 |
| 4,871,067 | 10/1989 | Valenti | 229/164 |
| 4,925,087 | 5/1990 | Ostrander | 229/162 |
| 5,350,111 | 9/1994 | Vosbikian | 229/162 |

FOREIGN PATENT DOCUMENTS

| | | | |
|---|---|---|---|
| 1395848 | 3/1965 | France | 229/115 |
| 1540393 | 2/1979 | United Kingdom | 229/115 |

*Primary Examiner*—Gary E. Elkins
*Attorney, Agent, or Firm*—Eckert Seamans Cherin & Mellott

[57] ABSTRACT

A box is useful for both shipping and displaying products for selection, especially elongated products such as brooms and mops. For shipping, the box is a full rectangular enclosure. For display, top and front panels can be removed or folded back to enable viewing and access to the products. Opposing panels define side walls and a back wall, and are joined by a bottom panel to define a partial enclosure, e.g., of the same height as the product. A lower front panel bridges between the side panels, and is vertically much shorter, e.g., attached to the side walls and the bottom at the front and extending only a short distance vertically. The remainder of the front of the box is open, except for a reinforced support piece bridging across the front of the box to the side walls. The support piece resists compression and can be made of one or more of wood, plastic, metal or thick, layered cardboard or corrugated craft. The support piece can be constructed as folded-up segments of a front box panel. The support piece prevents the display box from deforming or spilling product being spaced from the top to confine products that tilt forwardly. A product is removed by simply lifting the bottom edge over the lower front panel, thereby raising the top of the product above the open top, and pulling the product from the bottom end forwardly.

24 Claims, 4 Drawing Sheets

PRODUCT DISPLAY BOX

This application is a continuation-in-part of application Ser. No. 08/005,666, filed on Jan. 19, 1993, now U. S. Pat. No. 5,350,111 issued Sep. 27, 1994.

BACKGROUND OF THE INVENTION

1. Field of the Invention

This invention relates to boxes for displaying a product, and more particularly to a reinforced product display box especially for elongated items such as brooms, mops and the like.

2. Prior Art

Product display boxes are used by merchants and the like to hold and display products for sale. Often, the same boxes used by merchants to display the product are the boxes in which the manufacturer ships the product to the merchants. Shipping generally requires a complete and durable enclosure, and may further require internal supporting structures to protect the product from impacts. On the other hand, display requires a pleasing presentation, a good view of the product and access to the product allowing removal from the box. Combination shipping/display boxes may have flaps or panels which can be removed after shipment, tucked away or otherwise moved to expose the product for display.

Typically, the product is shipped in a square or rectangular box. The box has a top and/or front section that is removable to expose the product to consumers and to allow consumers to select product from the box for purchasing. Although the removal of a top or front section is helpful for viewing and access, it adversely affects the structural integrity of the box. For many types of products, detracting from the structural integrity of the box in this manner is not a problem because the box is rarely moved when positioned for product display, e.g., not until its supply of product is exhausted and the box can be discarded. After removal of a top or front panel, most types of display box are still adequate to contain the product to prevent product spillage.

When the box is used to display an number of larger or elongated items, such as brooms or mops, removal of a top or front panel can cause structural problems that detract from the display aspects of the box. The display box may partly collapse, thus presenting an unacceptable appearance. Product may lean or fall from the display/access openings provided in the display box. Such problems with the display box make the product less appealing to consumers, even if the product itself is not at all affected.

In a known prior art shipment and display box intended for shipping elongated items, the box is essentially rectangular in shape, defining a volume that is closed by flat panels on all six sides for shipment. To display the product to potential customers at its destination, the entire front face of the box is removed. The top of the box usually is also removable to facilitate removal of product from the box by lifting it upward and tilting it forward. The display structure that remains from the original closed rectangular shipping box has only a bottom, a back and two lateral sides. Although these panels are connected to one another along their abutting edges, the structure is flimsy due to the tendency of the relatively unsupported panels to bend and to hinge at their junctions. Such a box tends to lose its original rectangular shape, and can easily tilt and/or topple, spilling the product.

To deal with this problem, it is possible to retain a portion of the front panel bridging between the side panels, to better support the side panels at their front edges. This retained portion must be relatively large in order to provide any meaningful support. A narrow web of cardboard bridging between the side panels, for example, may resist tension but is free to flex and cannot resist compression, allowing the side panels to collapse inwardly toward one another.

A majority of the front portion can be retained on the box during product display and sale, better to retain the shape of the box. Usually, the top of the box and a limited portion of the front near the top are removed to allow removal of product from the box by lifting it mostly upwardly, over the top edge of the front panel. Occasionally, a lower section of the front is also removed to provide a better view of the product, for example for viewing the operative end of a broom or mop. This type of product display box is sturdier and less prone to toppling over than one having its front and top removed. However, the additional structural support clearly limits the access and display aspects of the box.

A drawback of a display box having a relatively large retained from piece is that in order to remove product from the box, it must be lifted up and over the top edge of the front piece. This is awkward and cumbersome, especially where the product is an elongated item such as a broom or mop. It is that much more difficult where the box is raised above the floor, e.g., on a shelf, or where the customer is short. Lifting the elongated item over the box carries the danger that the purchaser can lose control of the item and strike himself or herself, a nearby customer, child or infant, or nearby items of stock. Furthermore, other pieces of product can become engaged with one being lifted out, causing pieces to spill out of the box when attempting to remove one. Also, product viewing is inhibited by the front wall.

There is a need to resolve the conflicting needs for a box that remains sturdy when adapted for display, and that allows open viewing and good access, particularly a box for elongated items.

SUMMARY OF THE INVENTION

It is an object of this invention to provide a shipping box for containing products, which box is adaptable also to display the products for selection, e.g., in a retail store or the like, and which is optimized for both shipping and display.

It is another object of this invention to provide a display box which is sturdy and allows easy viewing and access of the displayed product.

These and other objects are accomplished by a box for shipping as well as displaying product for selection. The box has a pair of opposing side panels having substantially equal height. A back wall is attached to the opposing side panels and the back edges, to produce a three-sided enclosure. The back wall is essentially the same height as the opposing side walls. The bottom edges of each of the opposing side walls and back wall are fixed to a bottom panel to close the bottom of the enclosure. A front panel is disposed across front edges of the opposing side panels. The front panel is vertically much shorter than the side panels and is disposed near the bottom of the box. Preferably, the front panel is affixed to a front edge of the box bottom. The remainder of the front of the box is open except for a reinforced support piece affixed across the front of the box to respective edges of the opposing side walls. The reinforced support piece can be made of wood, plastic, metal or thick, layered cardboard or corrugated craft.

In a preferred design, the reinforced support piece is fashioned from one or more folded layers of what was part of a front of the box. The reinforced support piece withstands tension and compression, and prevents the display box from collapsing, tilting or spilling product from the display box. The display box preferably has an open top to facilitate removal of product from the top of the box. Since the front of the box is essentially open, it is also possible to remove product from the open box front, e.g., by tilting the top of an item of product under the reinforced support piece, or by slightly lifting the item and tilting the item to move the bottom of the item over the low front panel.

It is preferable to ship product in the same box where it will be displayed, so as to obviate a need for transferring product from a shipping container to a display container at the point of sale. It is not practical to ship a product in a box that has access/display openings such as the open-front display stand described above. It is therefore preferable to make the box a continuous enclosure and to include a detachable front panel. The front panel may be detachable via perforations, or marked for cutting. The detachable panel is arranged on the box between front edges of the side walls and between the support piece and lower front panel. In this manner, during shipment the front wall remains in place to prevent spillage of product from the box and also to add an extra measure of integrity and structural support. When preparing the product for display, the front panel is removed to expose the product. The support piece provides all the support of the box that is necessary after shipment for stationary product display, being effective in tension to prevent the sidewalls from splaying and effective in compression to prevent the sidewalls from bending inwardly at the front.

In a preferred design, a portion of the front panel is removed for display. The remainder has vertical and horizontal perforations, preferably disposed across the width of the front of the box and along the front edges of the side walls, which allow the remainder of the front panel to be folded to form the reinforced support piece.

Likewise, the top of the box is preferably open in the display mode to allow for extraction of the product from the box top and/or to allow the top edge of the product to be raised above the top of the box by a sufficient distance to enable the bottom of the product to pass over the lower front panel. During shipment, it is obviously preferable to confine the product in a box with a closed top. The box top preferably is also integral to the box and has means such as perforations about its periphery enabling removal at the point of sale after shipment, or allowing the top to be folded out of the way, e.g., to the rear of the back panel.

The invention provides a means for transporting and displaying products, especially elongated products arranged vertically in the box, with minimal trade-off between product visibility and access vs. box stability in the display mode.

BRIEF DESCRIPTION OF THE DRAWINGS

The invention will now be described with reference to the detailed description which follows in conjunction with exemplary embodiments as shown in the attached drawings, in which.

DETAILED DESCRIPTION OF THE PREFERRED EMBODIMENTS

The invention comprises a box adapted for both product shipping and display, having a pair of opposing side walls, the side walls each having a back edge, a front edge, a bottom edge, and upper and lower sections, the side walls having a height. A back wall is affixed to the opposing side walls at their back edges, the back wall having a bottom edge and a height substantially equal to that of the side walls, such that the side and back walls define an enclosed space. A bottom is affixed at the bottom edges of the side and back walls. A front panel is affixed to the front edges of the side walls, the front panel having a height substantially less than that of the side and back walls. A reinforced support piece is affixed at an upper section of the side walls at their front edges and bridges across the enclosed space. The support piece retains the shape of the box, and inhibits the box from collapsing or leaning due to deflection of the side walls, when filled with product for display.

The reinforced support piece can be fashioned from a section of a removable front panel, which is folded to form the support piece.

The box is particularly adapted for shipping and displaying elongated products in a manner that makes them easily viewed and accessible for removal by the consumer. In this description of the preferred embodiments, it is assumed that the products are elongated vertically, and terms such as "top," "bottom," "vertical," "side" and the like are used according to this assumption. It will be appreciated that the invention is fully applicable to boxes which contain products that are not vertically elongated, such as horizontally elongated products. The foregoing terms are thus intended for interpretation relative to one another, and not as limiting the invention to a particular orientation of the box.

Figure 1:
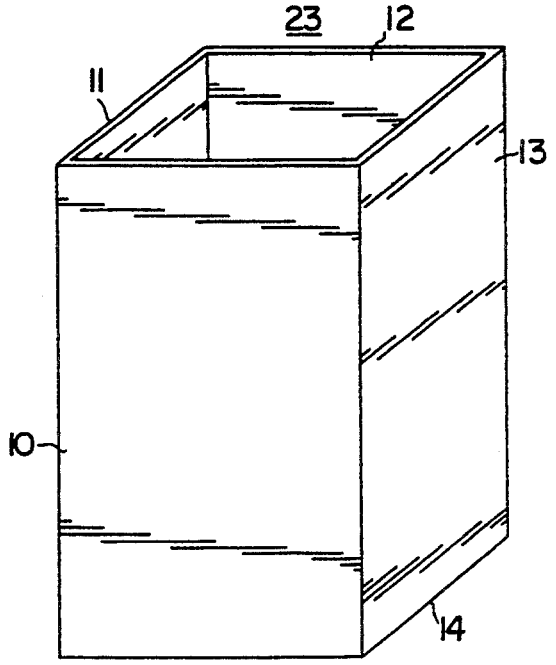
FIG. 1 PRIOR ART
FIG. 1 is a perspective view of a prior art display box.

FIG. 1 depicts a conventional prior art display box 23. Display box 23 of FIG. 1, having connected front 10, side 11, back 12 and side 13 as well as bottom 14, is relatively sturdy so long as its respective panels are intact. Box 23 shown in FIG. 1 is unlikely to topple or collapse, and substantially resists deformation even when containing product, due to the continuity of its front, side and back walls and the integrally attached bottom 14.

A difficulty with box 23 according to FIG. 1 is that access to the displayed product is available only through the open top. In order to remove a product for purchase, a purchaser must lift the desired product up a substantial height. The lowermost end of the product must be lifted clear of the top edges of front 10, sides 11, 13 and back 12 in order to view the product or to remove it from the box. The limitations on view and easy access are inconvenient and could inhibit a purchaser. For small products, the user may further have to reach down into the box. For elongated products such as mops or brooms, the product must be lifted by its entire length clears the top sections of front wall 10, side walls 11, 13 and back wall 12. The problem with access and viewing is exacerbated if display box 23 is located above ground level, for example on a shelf or the like. The product is almost completely inaccessible and hidden from view in the box.

Figure 2:
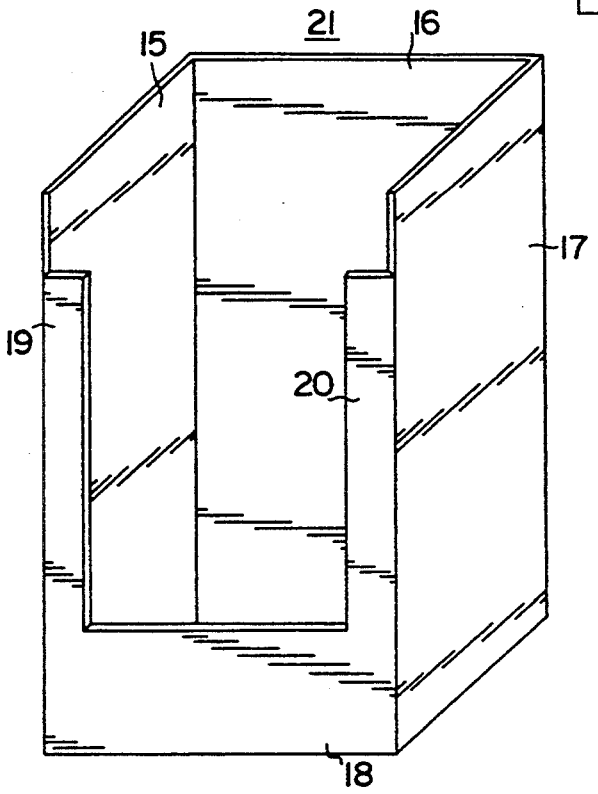
FIG. 2 PRIOR ART
FIG. 2 is a perspective view of another type of prior art display box.

A conventional adaptation of the box 23 is shown in FIG. 2, and is intended to improve access and viewing of a displayed product. The display box 21 shown in FIG. 2 has side wall 15, back wall 16 and side wall 17, and a bottom 29. However, the front wall is missing a substantial portion bridging between the side walls 15, 17. In the example shown, display box 21 has front panel 18, a left side strip 19 and right side strip 20. Side strips 19.20 extend only a limited distance across the front of the box and thus do not support the tops of the side walls 15, 17 against splaying outwardly or bending inwardly. However, the substantially open front of display box 21 allows a purchaser see the full upper length of the product, to grasp a desired product and to pull it from the box without lifting it up and over the side walls 15, 17. The low front panel 18 and left and right side strips 19 and 20 connected thereto provide a modicum of product retention and stiffen the box at the bottom only. Without the low front panel 18, the bottom ends of the product could escape, allowing the product to fall from box 21. However, the lower panel does not prevent product from tilting over from the top and falling out of box 21. Since elongated, cumbersome products such as mops and brooms have a tendency to become tangled and intertwined, it frequently occurs that extraneous product falls forward through the front opening of box 21 when a purchaser selects a desired piece of merchandise for purchase.

The absence of a full front wall in box 21 makes the box structurally weak and unable to retain its rectilinear shape. Over time, especially as product is removed from box 21, the respective side walls tend to lean, collapse, or fold inwardly, becoming both unsightly and unable to meet the needs of supporting the product while permitting viewing and access.

Figure 3:
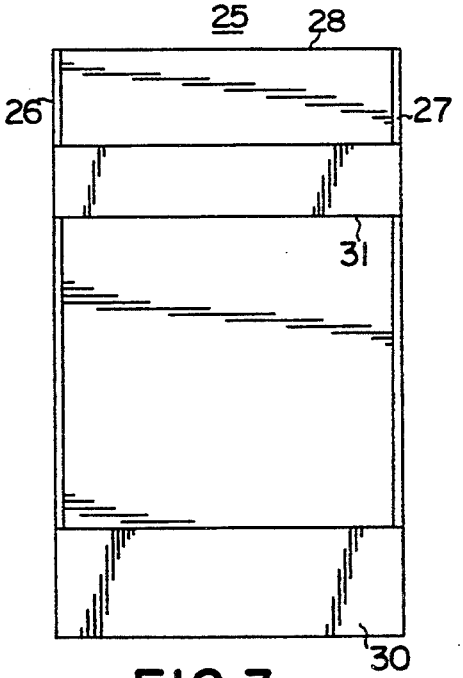
FIG. 3 is a front elevated view of the display box of the invention.

FIGS. 3–11 illustrate the improved shipping/display box according to the invention. The invention confines the product while eliminating problems of product access, obscured view and unstable box shape. As shown in FIG. 3, box 25 has side walls 26 and 27 and back wall 28. Each of side walls 26 and 27 and back wall 28 are substantially the same height. Box 25 also has a bottom 29 (not shown in FIG. 3) affixed to side walls 26 and 27 and back wall 28. Also affixed to the bottom 29 of box 25 is a low front panel 30 that retains the bottom ends of the products.

Box 25 includes reinforced support strip 31, affixed across a front of box 25 to front edges of side walls 26 and 27. This reinforced support strip 31 operates in tension to prevent the side walls 26, 27 from splaying, and due to its reinforcement also operates in compression to prevent the side walls 26, 27 from bending inwardly.

Figure 4:
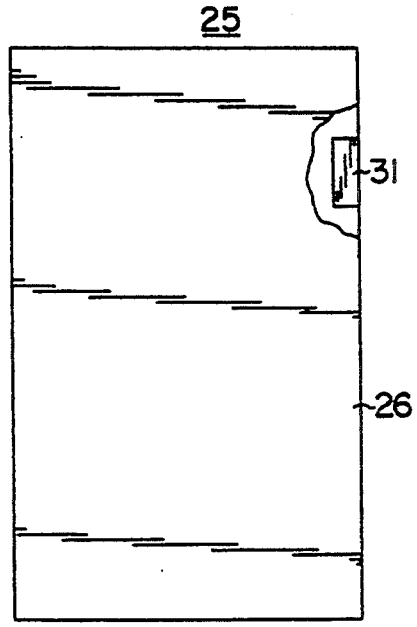
FIG. 4 is a side elevated view of the invention having a cut-away section showing the reinforced support piece.

As more clearly shown in FIG. 4, support strip 31 can be reinforced to withstand compression by having a thickness greater than the material of the box, e.g., formed of successive layers of corrugated craft. Alternatively, a distinct material can be used to span across the box, e.g., comprising a rigid member affixed behind a surface layer of the box material. In any event, the strip 31 is preferably substantially rigid. It is preferred to reinforce strip 31, for example, by attaching a wood, metal, plastic or multi-layered cardboard form spanning across the side walls 26, 27. Reinforced support strip 31 adds rigidity and structural stability to box 25 that it otherwise would not have. The box is much sturdier as compared to prior art boxes 21 and 23 and is therefore less prone to lean, topple or collapse. Furthermore, by positioning reinforced support strip 31 towards the top of box 25, the top ends of elongated products such as mops and brooms are prevented from tilting forward and falling out of box 25.

However, since the front of box 25 is relatively open, the view of the product is not obscured over most of the product height. Access is not substantially inhibited since a purchaser need only lift the product high enough for the bottom of the product to clear front panel 30, whereupon the product is readily withdrawn from box 25 from its bottom end. It is not necessary to lift the product up and over side walls 26 and 27, back wall 28 or reinforced support strip 31.

As shown in FIGS. 3 and 4, reinforced support strip 31 is affixed across a front of box 25 and attached to side walls 26 and 27. Reinforced support strip 31, as shown in cutaway in FIG. 4, is essentially an elongated square or rectangular piece and is constructed preferably of plastic, metal, wood or layers of cardboard. Reinforced support strip 31 adds structural stability to box 25 and prevents torque forces on side walls 26, 27 and back wall 28 from causing box 25 to collapse.

In the preferred embodiment shown, the support strip 31 is not placed at the extreme top of the side walls 26, 27. Instead, the support strip is placed lower, whereby a product having its lower end at the rear edge of the bottom (against the rear wall) and is tilted forwardly, cannot pass under the support strip 31 and fall forwardly out of the box. The precise distance by which support strip 31 is displaced from the top edge will vary with the distance between the front and rear walls of the box.

Figure 5:
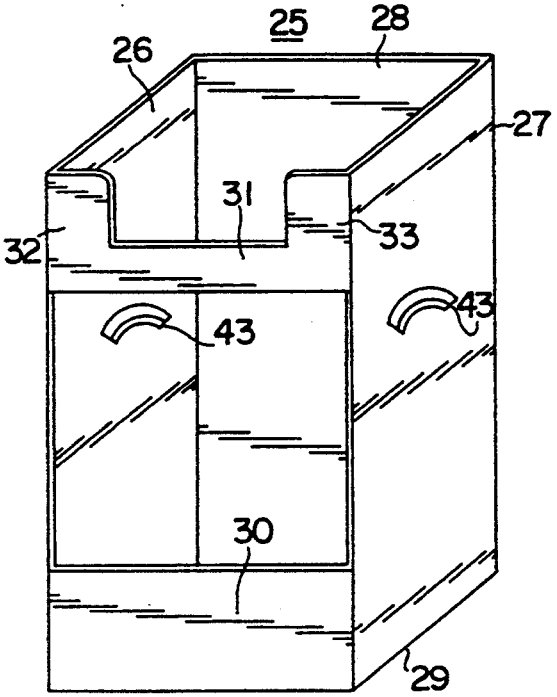
FIG. 5 is a perspective view of a preferred embodiment of the invention.

A preferred embodiment of box 25 is shown in FIG. 5. As shown, box 25 has side walls 26 and 27 and back wall 28, all of substantially equal height, approximately equal to the vertical dimension of the product. Side walls 26 and 27 have handles formed by small cut-outs through side walls 26 and 27. Handles 43 also can be provided in the form of separate units attachable to side walls 26 and 27 and arranged to be grasped. Box 25 has bottom 29 and front panel 30. Box 25 has reinforced support strip 31 across a front of box 25 and affixed at side walls 26 and 27. As shown in FIG. 5, box 25 also has upper corner pieces 32 and 33 adding additional support to box 25 as well as a degree of ornamentation to box 25.

Figure 6:
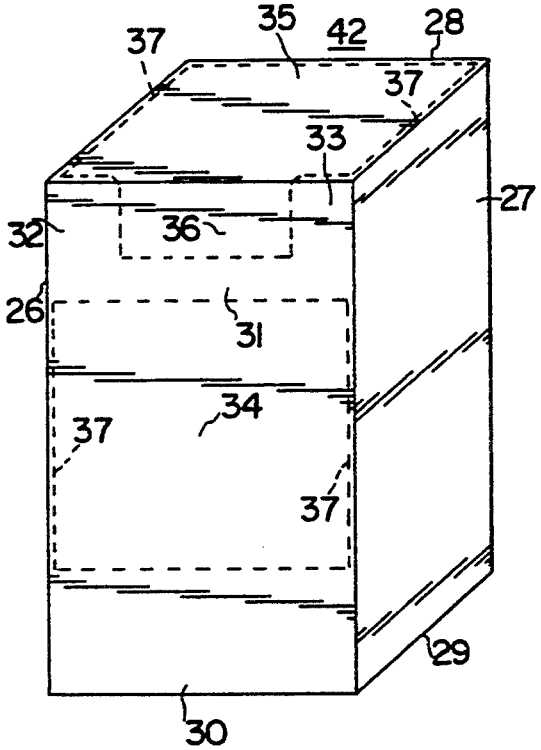
FIG. 6 is a perspective view of the invention showing perforations for changing the box from a shipment box to a display box.
Figure 9:
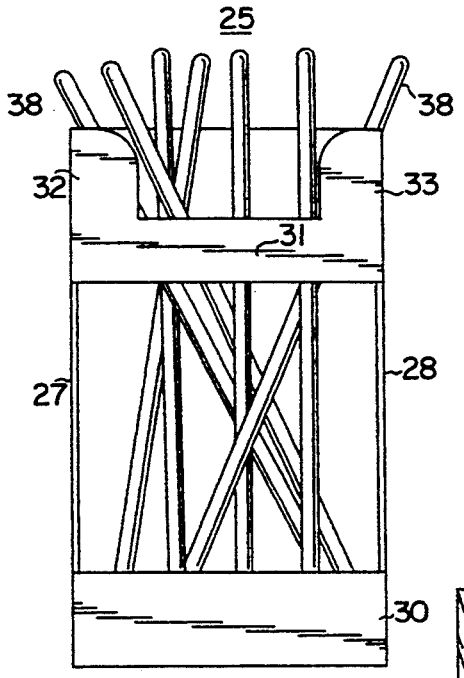
FIG. 9 is a front elevated view of the invention containing product for display.

FIG. 6 represents a display box for containing product for shipment as well as display upon reaching a point of sale. As shown in FIG. 6, box 42 has side walls 26 and 27 and back wall 28. As in other embodiments, box 42 as shown in FIG. 6 has front panel 30 and reinforced support strip 31. Box 25 also has upper corner pieces 32 and 33. However, in the embodiment of FIG. 6, box 42 has removable from 34 and removable top 35. Removable top 35 has front flap 36 depending downward into a recess defined by upper corner pieces 32 and 33 and reinforced support strip 31. Box 42 therefore is a complete enclosure providing the necessary protection and support for shipping product for example, by train, truck or the like. Removable front 34 is attached by perforations 37 to side walls 26 and 27, front panel 30 and reinforced support strip 31. Removable top 35 is affixed to side walls 26 and 27, back wall 28, reinforced support strip 31 and upper corner pieces 32 and 33 by perforations 37. After shipment, removable front 34 and removable top 35 can be torn away from box 25 at the lines of perforation 37. Removal of removable front 34 and removable top 35 results in a box as depicted in FIG. 5 for displaying product for sale. For example, box 25 can be loaded with elongated items such as brooms 38 for sale at a retail store or the like as shown in FIG. 9.

Figure 7:
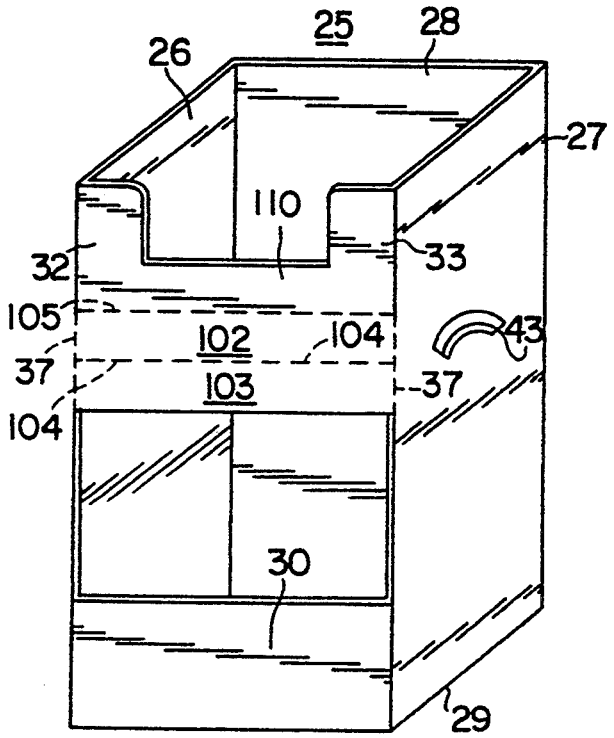
FIG. 7 is a perspective view of another embodiment of the invention having foldable slats transformable into a reinforced support piece.

As shown in FIG. 7, panel 110 is disposed across front edges of sides 26 and 27 near the top of box 25. Folding support slat 102 is joined to panel 110 at fold line 105, which could be perforations or a crimp in the material from which box 25 is constructed. Folding support slat 103 is joined to folding support slat 102 at fold line 104. Support slats 102 and 103 preferably are joined at their edges to the front edges of side walls 26 and 27 at perforation line 37. Slats 102 and 103 preferably are constructed of the same material, usually corrugated craft, as the other sections of box 25.

To deploy the slats as reinforcement pieces the slats are folded upon one another at fold line 104 into a position of substantial abutment, and then upon panel 110 at fold line 105. The abutment of slats 102, 103 and panel 110 provides a relatively thick reinforcing member across the front of box 25 to prevent deformation or collapse.

Slats 102 and 103 are substantially equal in length to the width of box 25 i.e. the distance between side walls 26 and 27. Therefore, slats 102 and 103 are preferably held in place in their folded position abutting one another and panel 110 by frictional forces imparted on the ends of slats 102 and 103 by side walls 26 and 27. However, glue could by used to further secure the slats into a position of abutment with one another and with panel 110.

Figure 8:
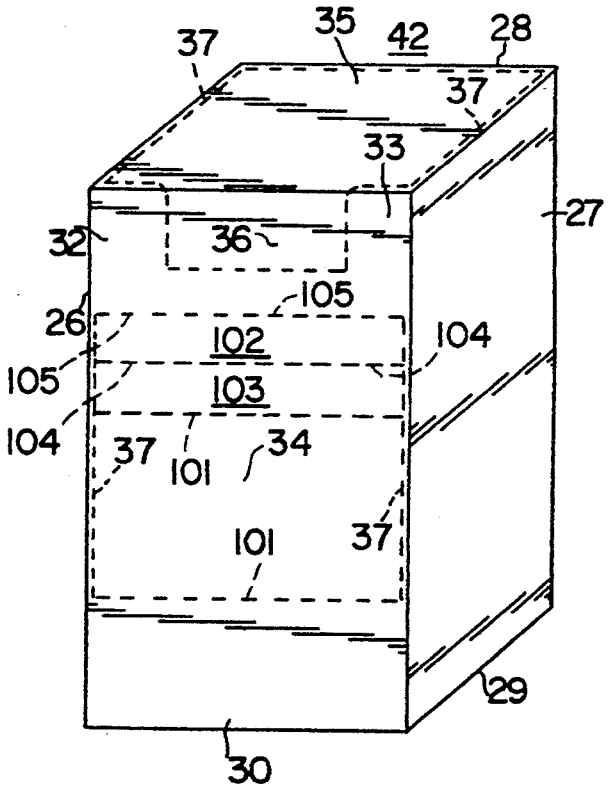
FIG. 8 is a perspective view of the invention showing perforations for changing the box from a shipment box to a display box and wherein a front of the box is transformable into the reinforced support piece.

FIG. 8 shows a preferred modification to the box FIG. 6. Removable front 34 separates from box 25 at side perforations 37 and top perforation 101. Folding support slats 102 and 103 are joined at fold line 104. Perforation lines 37 continue on opposite sides of slats 102 and 103. Slats 102 and 103 are constructed of the same material, usually corrugated cardboard, as the other sections of box 25.

After shipping, when box 25 has arrived at a store and been placed in a position for display of product, removable front 34 can be torn away from box 42 at perforation lines 37 and 101. Slat 103 is folded at fold line 104 into a position substantially abutting slat 102. Abutted slats 102 and 103 are then folded at fold line 105 into a position substantially abutting panel 110. Slats 102 and 103, along with panel 110 provide a reinforcing member to prevent deformation or collapse of box 25.

Slats 102 and 103 are substantially equal in length to the width of box 25 i.e., the distance between side walls 26 and 27. Therefore, slats 102 and 103 are held in place in their folded position abutting one another and panel 110 by frictional forces imparted on the ends of slats 102 and 103 by side walls 26 and 27.

Although two slats are shown and described, it should be understood that as many number of slats as are desired, or as few as one, can be employed. When using a plurality of slats it is helpful to provide extra fold lines defining small segments, which extend over the bottom or top edges of already folded slats. In this manner, the thickness of a set of folded slats is compensated for when folding additional slats onto the support piece.

The embodiment of the invention shown in FIG. 8 and described above is easy to deploy and cost efficient in that material which would otherwise be discarded is used to fashion the support piece. No extra material is required.

Figure 10:
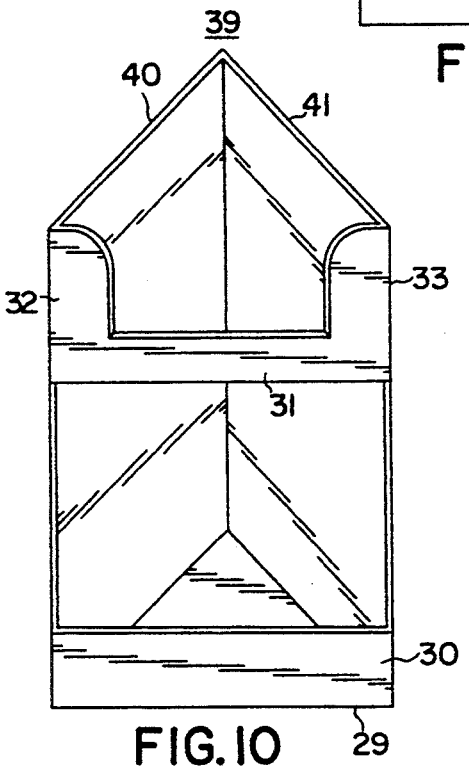
FIG. 10 is a front elevated view of the invention having a triangular shape.
Figure 11:
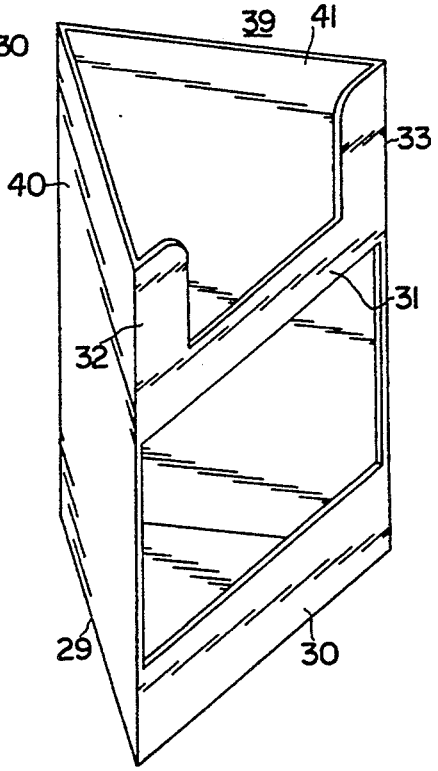
FIG. 11 is a perspective view of the alternate embodiment shown in FIG. 10.

FIGS. 10 and 11 show a further alternative embodiment. In FIGS. 10 and 11, box 39 is triangular in plan view, having connected walls 40 and 41 that together define the sides and back of the box. As in other embodiments, box 39 has front panel 30 and upper corner pieces 32 and 33. Reinforced support strip 31 is attached at from edges of walls 40 and 41 and adds structural stability and integrity to box 39. Triangular box 39 is particularly advantageous since triangularly shaped structures are known to be sturdier against collapse than rectangular or square structures, which can be deformed into parallelogram shapes.

This invention can be embodied using any number of box shapes and sizes. A number of other possibilities and variations will now occur to persons skilled in the art and aware of this disclosure. The invention is intended to encompass such variations that embody the inventive concept, and accordingly reference should be made to the appended claims rather than the foregoing specification to assess the scope of the invention in which exclusive rights are claimed.

What I claim is:

1. A box for product display, comprising:

a pair of opposing side walls, said side walls each having a back edge, a front edge, a bottom edge, and upper and lower sections, said side walls having a height;

a back wall, said back wall disposed at said opposing side walls at said back edges, said back wall having a bottom edge and a height substantially equal to said side walls, said side and back walls defining an enclosed space;

a bottom coupled at said bottom edges to said side and back walls;

a front wall disposed at said front edges of said side walls at said lower section, said front wall having a height substantially less than said side and back walls; and, wherein said box is substantially completely openable between the side and back walls over a top side opposite from the bottom, for access to contents of the box through the top side, and further comprising a reinforced support piece, said support piece disposed at said upper section of said side walls at said front edges across said enclosed space, said support piece inhibiting the box from deformation when open across said top side and filled with product for display.

2. The box of claim 1, wherein the front wall abuts said bottom.

3. The box of claim 1, further comprising a pair of upper corner pieces disposed perpendicularly to said side walls, disposed at said front edge of said side walls at a point above said support strip.

4. The box of claim 3, wherein said upper corner pieces contact said support strip.

5. The box of claim 1, wherein said box comprises cardboard.

6. The box of claim 1, further comprising a tear-out section attached to at least one of said front edges of said side walls, said front wall and said support strip by perforations, said tear-out section being removable from said box along said perforations after shipment for display of the product, whereby the same said box is useful for shipping and display.

7. The box of claim 1, further comprising a handle in at least one of said side walls.

8. The box of claim 7, wherein said handle is formed as an opening through said at least one side wall.

9. The box of claim 1, wherein a height of said box is substantially greater than a width and depth of said box.

10. A box for product display, comprising:

a pair of side walls, said side walls each having a back edge, a front edge, a bottom edge and upper and lower sections, said side walls having a height, said back edges abutting to define an enclosed space;

a bottom affixed at said bottom edges of said side walls;

a front wall disposed at said front edges of said side walls at said lower section, said front wall having a height substantially less than said side walls; and, wherein said box is substantially completely openable between the side walls over a top side opposite from the bottom, for access to contents of the box through the top side, and further comprising a reinforced support strip, said support strip disposed at said upper section of said side walls at said front edges, across said enclosed space, said support strip inhibiting the box from deformation when open across said top side and filled with product for display.

11. The box of claim 10, wherein the front wall is attached to said bottom.

12. The box of claim 10, further comprising a pair of corner pieces affixed to said front edges at said side walls in a same vertical plane as said front wall at a point above said support strip.

13. The box of claim 12, wherein said upper corner pieces contact said support strip.

14. The box of claim 10, wherein said box is constructed of cardboard.

15. The box of claim 10, further comprising a tear-out section attached to at least one of said front edges of said sides, said front wall and said support strip by perforations, said tear-out section being removable from said box along said perforations, whereby the box is useful for both shipment and for display of the product.

16. The box of claim 10, further comprising a handle in at least one of the side walls, said handle being formed as an opening through said at least one side wall.

17. The box of claim 10, wherein the support strip is spaced below a top of the side walls by a distance sufficient to confine a product of height equal to the side walls when tilting forwardly in the box.

18. The box of claim 10, wherein a height of said box is substantially greater than a width and depth of said box.

19. A box for product display, comprising:

a pair of opposing side walls, said side walls each having a back edge, a front edge, a bottom edge, a top edge and upper and lower sections, said side walls having a height;

a back wall, said back wall disposed at said opposing side walls at said back edges, said back wall having a bottom edge, a top edge and a height substantially equal to said side walls, said side and back walls defining an enclosed space;

a bottom coupled to said side and back walls at said bottom edges;

a front wall disposed at said front edges of said side walls at said lower section, said front wall having a height substantially less than said side and back walls; and, wherein said box is substantially completely open between the side and back walls over a top side opposite from the bottom, for access to contents of the box through the top side, and further comprising a panel disposed at said upper section of said side walls at said front edges across said enclosed space, said panel having an upper and lower edge, and front and back faces and at least one slat having a front and back face attached to said panel at said lower edge of said panel, said at least one slat being foldable into a position wherein either of said faces of said panel abut either of said faces of said slat to define a reinforcement inhibiting the box from deformation when open across said top and filled with product for display.

20. The box of claim 19, wherein said at least one slat is attached to said panel at a line of perforations.

21. The box of claim 19, wherein said at least one slat is attached to said panel at a fold line defined by a crimp.

22. The box of claim 19, having a plurality of slats foldable into a position wherein either of said faces of said slats abut either of said faces of another slat or either of said faces of said panel to define a relatively thick reinforcement inhibiting the box from deformation when open across said top and filled with product for display.

23. The box of claim 19, wherein said at least one salt is attached to at least one of said front edges of said side walls by perforations.

24. The box of claim 19, further comprising a tear-out section attached to at least one of said front edges of said side walls, said front wall and said at least one slat by perforations, and a tear-out section attached to at least one of said top edges of said side walls, said back wall and said panel be perforations, said tear-out sections being torn from said box along said perforations after shipment and display of the product, whereby the same box is useful for shipping and display.

* * * * *